US006485257B1

(12) United States Patent
Base et al.

(10) Patent No.: US 6,485,257 B1
(45) Date of Patent: Nov. 26, 2002

(54) TOP-FLOW CENTRIFUGAL FLUID PUMP

(75) Inventors: Howard J. Base, Macedonia, OH (US); Daniel J Olson, Twinsburg, OH (US)

(73) Assignee: Tom Richards, Inc., Mentor, OH (US)

( * ) Notice: Subject to any disclaimer, the term of this patent is extended or adjusted under 35 U.S.C. 154(b) by 0 days.

(21) Appl. No.: 09/663,146

(22) Filed: Sep. 15, 2000

Related U.S. Application Data

(60) Provisional application No. 60/154,573, filed on Sep. 17, 1999.

(51) Int. Cl.[7] ..... F04D 29/70

(52) U.S. Cl. ..... 415/121.2; 415/184; 415/205; 415/206

(58) Field of Search ..... 415/108, 116, 415/121.2, 184, 205, 206, 211.2, 217.1; 416/186 R, 223 B; 210/416.1

(56) References Cited

U.S. PATENT DOCUMENTS

| | | | | | |
|---|---|---|---|---|---|
| 2,383,424 | A | | 8/1945 | Stepanoff | |
| 2,808,782 | A | * | 10/1957 | Thompson et al. | 415/98 |
| 3,326,134 | A | * | 6/1967 | Ohmann | 415/175 |
| 4,253,798 | A | | 3/1981 | Sugiura | |
| 4,331,458 | A | * | 5/1982 | Liljestrand | 55/184 |
| 4,349,434 | A | * | 9/1982 | Jaworski | 210/94 |
| 4,373,860 | A | * | 2/1983 | Sloan | 415/185 |
| 4,618,425 | A | | 10/1986 | Yates | |
| 4,786,230 | A | | 11/1988 | Thut | |
| 4,817,561 | A | * | 4/1989 | Byrne et al. | 119/5 |
| 4,840,535 | A | | 6/1989 | Skarstad | |
| 5,021,151 | A | | 6/1991 | Yane | |
| 5,028,211 | A | * | 7/1991 | Mordue et al. | 4116/204 R |
| 5,246,336 | A | | 9/1993 | Furukawa | |
| 5,330,328 | A | * | 7/1994 | Cooper | 417/424.1 |

* cited by examiner

*Primary Examiner*—Edward K. Look
*Assistant Examiner*—Ninh Nguyen
(74) *Attorney, Agent, or Firm*—Fay, Sharpe, Fagan, Minnich & McKee, LLP

(57) ABSTRACT

A top-flow fluid pump that is made from a high-purity fluroplastic material is disclosed. The pump is used to circulate extremely corrosive fluids that are heated to temperatures of 160–180° C. through at least one filtration unit. The pump can be used in a semiconductor etching system. The pump utilizes the driven side of an impeller to generate a suction force that draws the corrosive fluid into a pumping chamber from at least one inlet port. A pedestal support or shaft sleeve, through which a motor drive shaft extends, is modified to create an annular passageway that permits the corrosive fluid to enter the pumping chamber from the inlet. With the inlet design of the present invention, a drive motor seal assembly is no longer subjected to corrosive fluid because the seal assembly is positioned on the suction side of the impeller. In a "dead headed" condition, the corrosive fluid flow stops completely as the fluid within the pumping chamber simply remains in shear.

21 Claims, 7 Drawing Sheets

TOP-FLOW CENTRIFUGAL FLUID PUMP

CROSS REFERENCE TO RELATED APPLICATIONS

This application claims the benefit of Provisional U.S. patent application Ser. No. 60/154,573, filed Sep. 17, 1999.

BACKGROUND OF THE INVENTION

The present invention relates to the fluid pumping and filtration arts. It finds particular application in conjunction with a top-flow centrifugal fluid pump for use in pumping highly-corrosive fluids, such as used in a semi-conductor etching system, and will be described with particular reference thereto. However, it should be appreciated that the present invention may also find application in conjunction with other systems and applications where the pumping and/or filtration of fluids is performed.

FIG. 1 illustrates an exemplary impeller-type fluid pump and filtration unit A for a semi-conductor etching system. The pump and filtration unit is disclosed in commonly-owned U.S. Pat. No. 5,021,151, which is hereby incorporated by reference for all that it teaches.

Briefly, the pump and filtration unit A includes a housing 10 having a pump chamber 12 and a filter chamber 14 spaced apart from the pump chamber. The pump and filter chambers 12, 14 communicate through an intermediate passageway or bore 16. An inlet port 18 of the housing communicates with an inlet 20 of the pump chamber. An outlet port 22 of the housing communicates with an outlet 24 of the filter chamber. A centrifugal-type fluid pump within the housing 10 includes an impeller 26 positioned within the pump chamber 12. A hollow impeller shaft sleeve 28 is secured to the impeller and extends through a bore 30 in the housing. A drive motor assembly 32 is secured to the housing by an adapter plate 34. An output shaft 36 of the drive motor extends through the adapter plate 34 and impeller shaft sleeve 28 and is secured to the impeller 26. A replaceable filter element 38 is located within the filter chamber 14.

The impeller 26 is formed from a first section 40 and a second section 42, each of which has a plurality of impeller vanes associated therewith. In particular, the impeller vanes 44 associated with first impeller section 40 draw fluid from the inlet port 20 to the pump chamber 12 in a direction toward the drive motor assembly 32. The impeller vanes 46 associated with the second impeller section 42 move fluid more efficiently than the impeller vanes 44 associated with the first section 40. As a result, a positive suction force is created by the impeller vanes 46 to prevent fluid from being pushed up into the bore 30 and potentially reaching the drive motor unit 32.

In operation, the pump and filtration unit A is located in a tank or tub together with a weir basket that holds microelectronic circuits or chips. The tub contains a corrosive chemical solution or fluid (e.g. corrosive acid(s) heated to 160–180° C.) which overflows the top of the basket and engulfs the unit A, and which is intended to etch the microelectronic circuits or chips. When the pump and filtration unit A is energized, the corrosive fluid is drawn from the inlet port 16 to the pump chamber 12 by the impeller 26. The impeller then pumps the fluid into the filtration chamber 14 and through the filter 38 before being discharged back into the tub at the outlet 22. Notwithstanding the positive suction force generated by the second impeller section 42, a seal assembly 48 (FIG. 2) such as a labyrinth seal assembly further prevents corrosive fluid from flowing between the shaft sleeve 38 and the adapter plate 34 to the drive motor assembly 32.

It should be appreciated that the drive motor assembly provides a very efficient means of pumping fluids when coupled to the centrifugal-type pump. High rotational speeds of the centrifugal-type pump 26 can produce high fluid-flow rates at moderate outlet pressures. However, when the outlet pressure increases (such as when the filter 38 becomes at least partially blocked with particles generated by the etching process), the fluid flow drops off sharply beyond the design parameters of the pump. In the most extreme case when the pump is "dead headed" (i.e. outlet 22 and/or 24 is blocked completely), the pressure created by the first impeller section 40 can force the corrosive fluid up the bore 30, past the seal assembly 48, and into the drive motor assembly 32. When pumping aggressive (i.e. highly-corrosive) fluids, this can result in the premature failure of the drive motor and/or the drive bearings.

Accordingly, it has been considered desirable to develop a new and improved top-flow centrifugal fluid pump for use in pumping corrosive fluids, which pump meets the above-stated needs and overcomes the foregoing difficulties and others while providing better and more advantageous results.

SUMMARY OF THE INVENTION

The present invention is directed to a fluid pump that is made from a high-purity fluroplastic material. The pump is used to circulate extremely corrosive fluids that are heated to temperatures of 160–180° C. through at least one filtration unit. The pump can be used in a semiconductor etching system. The pump utilizes the driven side of an impeller to generate a suction force that draws the corrosive fluid into a pumping chamber from at least one inlet port.

A pedestal support or shaft sleeve, through which a motor drive shaft extends, is modified to create an annular passageway that permits the corrosive fluid to enter the pumping chamber from the inlet. With the inlet design of the present invention, a drive motor seal assembly is no longer subjected to corrosive fluid because the seal assembly is positioned on the suction side of the impeller. In a "dead headed" condition the corrosive fluid flow stops completely as the fluid within the pumping chamber simply remains in shear.

Thus, in one aspect of the present invention a fluid pump is disclosed. The fluid pump includes a housing defining a pump chamber; a single fluid inlet communicating with the pump chamber; an impeller positioned within the pump chamber; and a drive shaft extending through the fluid inlet and coupled to the impeller.

In a second aspect of the present invention, a corrosive fluid pumping system including a tub adapted to hold a corrosive fluid and a fluid pump is disclosed. The fluid pump includes a housing defining a pump chamber; a single fluid inlet communicating with the pump chamber; an impeller positioned within the pump chamber; and a drive shaft extending through the fluid inlet and coupled to the impeller.

Accordingly, one advantage of the present invention is the provision of a fluid pump that prevents corrosive fluid from reaching a drive motor unit during a worst-case, "dead-headed" operating condition of the fluid pump.

Another advantage of the present invention is the provision of a fluid pump having at least one inlet port positioned intermediate a pumping chamber and a drive motor housing.

Yet another advantage of the present invention is the provision of a fluid pump having an impeller that draws fluid into a pumping chamber in a direction away from a drive motor housing.

Still further advantages of the present invention will become apparent to those of ordinary skill in the art upon reading and understanding the following detailed description of the preferred embodiments.

BRIEF DESCRIPTION OF THE DRAWINGS

The invention may take form in various components and arrangements of components, and in various steps and arrangements of steps. The drawings are only for purposes of illustrating the preferred embodiments and are not to be construed as limiting the invention.

DETAILED DESCRIPTION OF THE PREFERRED EMBODIMENTS

Figure 2:
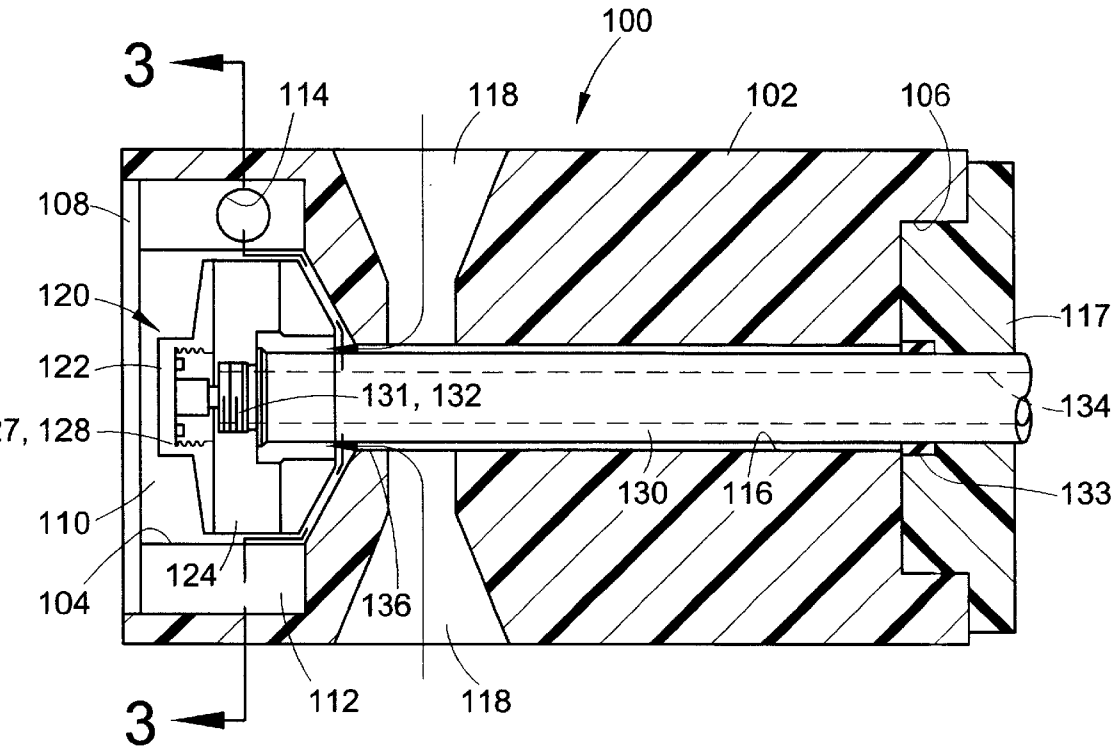
FIG. 2 is a longitudinal cross-sectional view, taken along the line 2—2 of FIG. 3, of a top-flow centrifugal fluid pump according to a first preferred embodiment of the present invention.
Figure 3:
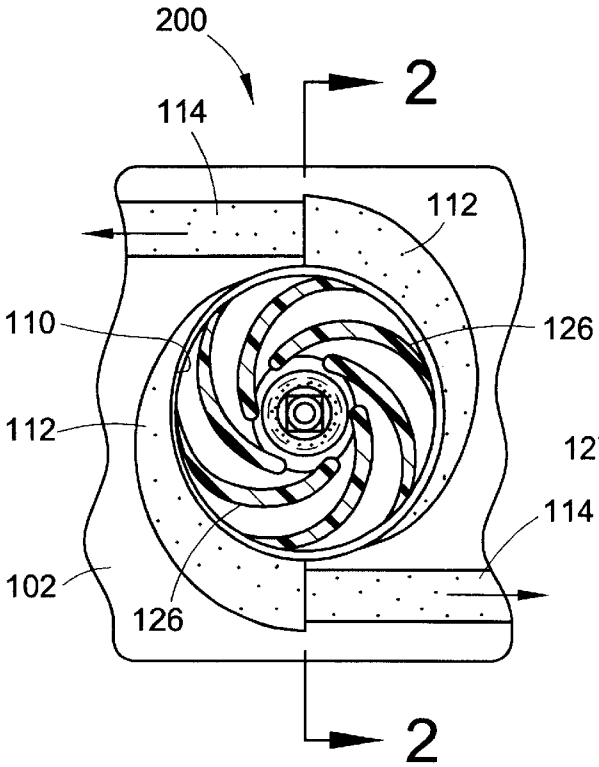
FIG. 3 is a cross section view of an impeller of the top-flow centrifugal fluid pump taken along the line 3—3 of FIG. 2.

With reference now to FIGS. 2 and 3, a top-flow centrifugal fluid pump 100 incorporates the features of the present invention therein. The pump 100 includes a housing 102 with a cavity 104 at a first end of the housing and a counter-bored recess 106 at a second end of the housing. An end plate 108 is sealed to the first end of the housing.

The end plate 108 and the cavity 104 cooperate to define a closed pump chamber 110. The pump chamber 110 is surrounded by two opposing outlet passageways 112 that spiral radially outward in an involute manner from opposing sides of the pump chamber 110. In particular, one end of each passageway 112 communicates with the pump chamber 110, and the other end of each passageway communicates with a respective outlet port 114 that extends through the housing. The outlet ports are oriented in generally opposite directions through the housing 102.

A central bore 116 extends longitudinally between the pump chamber 110 and the counter-bored recess 106. The counter-bored recess is adapted to receive an adapter plate 117 and an attached drive motor assembly (not shown). A plurality of circumferentially-spaced inlets 118 extend radially through the pump housing 102 and communicate with the central bore 116 at a location intermediate the pump chamber 110 and the counter-bored recess 106.

An impeller 120 is positioned within the pumping chamber 110. In the embodiment being described, the impeller 120 includes a first or cap portion 122 and a second or driven portion 124. The second or driven portion 124 includes a plurality of impeller vanes 126 associated therewith. The first and second impeller portions 122, 124 can be joined together in any suitable manner such as by threaded male and female members 127, 128, respectively.

A hollow shaft sleeve 130 extends through the central bore 116. A first or distal end of the shaft sleeve 130 is secured to the impeller second section 124, such as by cooperating threaded portions 131 and 132, and a second or proximal end of the shaft sleeve 130 passes through the adapter plate 117 at a second end. A seal assembly 133 such as a labyrinth seal assembly is interposed between the shaft sleeve 130 and the adapter plate 117 to prevent corrosive fluid from reaching the drive motor assembly. A motor output shaft 134 extends through the center of the shaft sleeve 130 and is secured to the impeller 120 for rotation therewith.

The inlet ports 118 communicate with the pump chamber 110 through an annular passageway 136 defined between the shaft sleeve 130 and the cylindrical side wall defining the central bore 116. The size and shape of the passageway 136 can be optimized to control the flow of corrosive fluid from the inlet ports 118 to the pump chamber 110.

Any one or more of the top-flow centrifugal fluid pump 100 components including the pump housing 102, first and second impeller portions 122, 124, and shaft sleeve 130 can be made from or coated with suitable corrosion and high-temperature resistant materials such as PTFE (polytetrafluoroethylene), quartz, etc.

In operation, the pump 100 is placed in a tank or tub of corrosive fluid so that the inlet ports 118 are fully submerged. It should be appreciated that the corrosive fluid will rise to a certain level within the central bore 116 as the pump housing is submerged within the corrosive fluid. When the drive motor is energized, the motor output shaft 134 and attached impeller 120 and shaft sleeve 130 are caused to rotate. As a result, a positive suction force is generated by the rotating impeller vanes 126 associated with the second impeller portion 124. The suction force draws corrosive fluid from the inlet ports 118 through the passageway 136 and into the pump chamber 110. The suction force also draws the column of corrosive fluid within the bore 116 away from the seal assembly 133. Thus, corrosive fluid is drawn into the pump chamber 110 in a direction away from the seal assembly 133, and then into the spiral passageways 112 and outlet ports 114. One or more suitable filtration units can be connected to one or both of the outlet ports 114 to provide a filtration capability to the top-flow fluid pump 100.

In a worst case scenario where both outlet ports 114 are blocked (i.e. the pump 100 is "dead-headed"), the flow of corrosive fluid completely stops and the fluid within the pump chamber 110 remains in shear. That is, the impeller 120 is unable to draw additional fluid into the pumping chamber 110 through the annular passageway 136 from the inlet ports 118. Further, in contrast with the impeller 26 (FIG. 1), the rotating impeller 120 does not drive or otherwise pump or force corrosive fluid back up into the bore 116 toward the seal assembly 133. Even if the corrosive fluid does reach the seal assembly 133, no forces are generated by the impeller 120 that would cause the seal assembly 133 to fail and thus expose the drive motor unit and/or drive bearings to the corrosive fluid.

Figure 1:
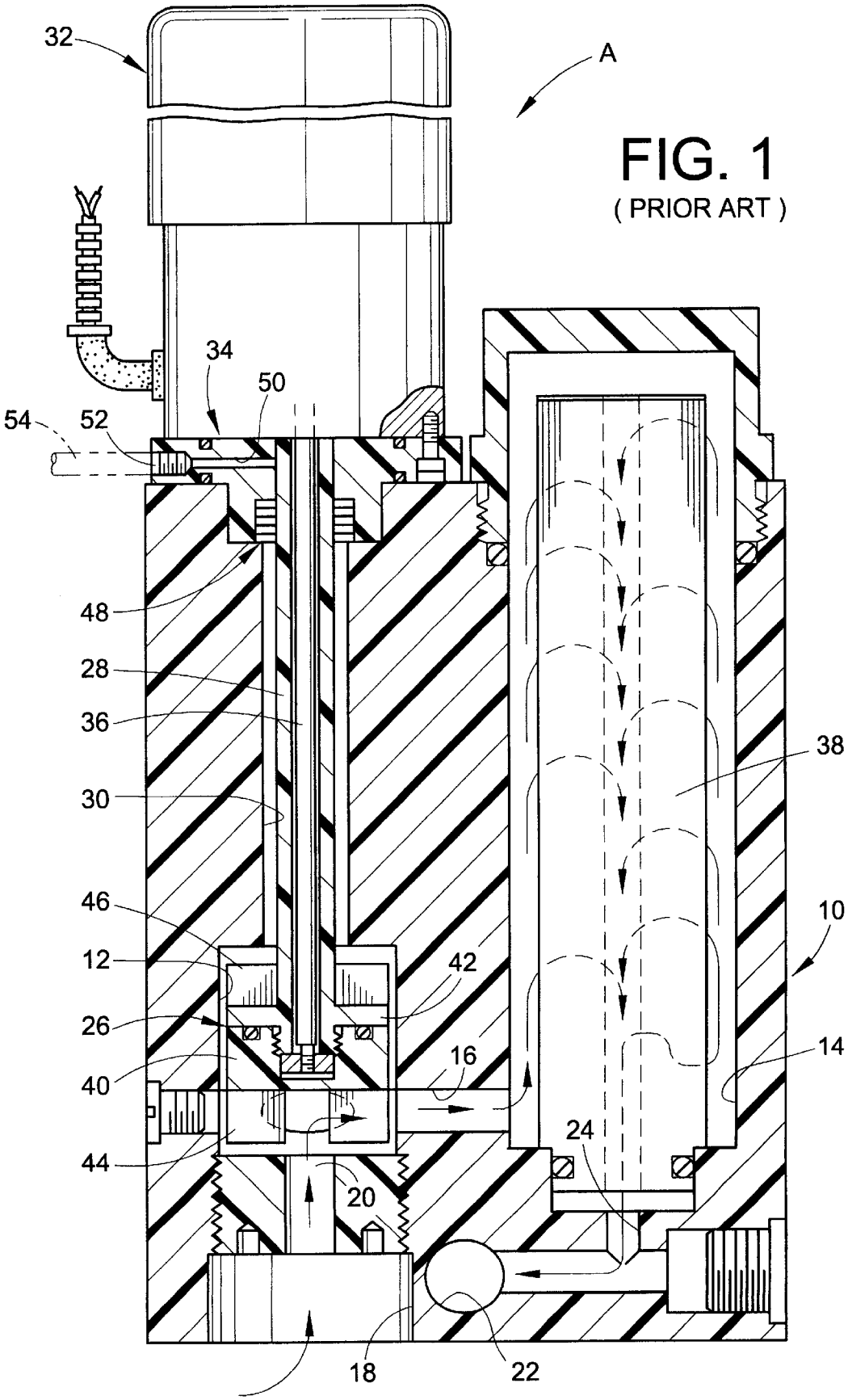
FIG. 1 ( PRIOR ART )
FIG. 1 is a front elevation view, in partial cross-section, of a pump and filtration unit according to the prior art.
Figure 5:
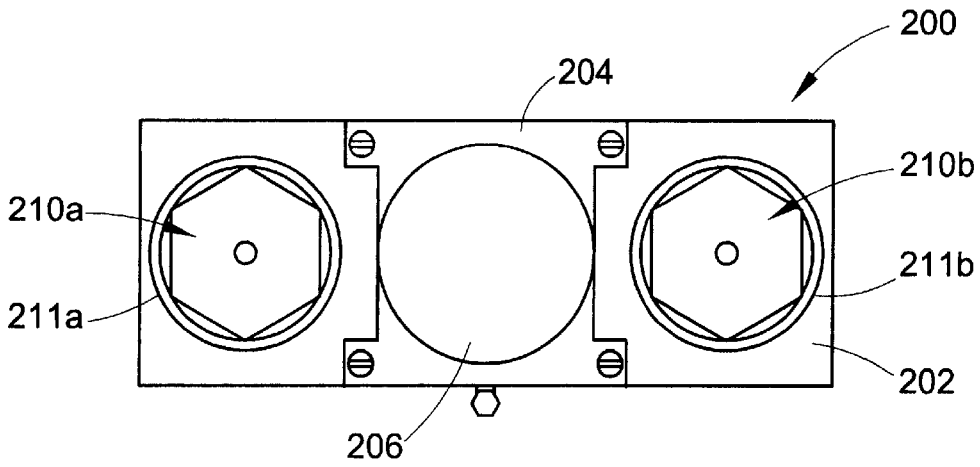
FIG. 5 is a top view of the top-flow centrifugal fluid pump and dual filtration unit of FIG. 4.
Figure 4:
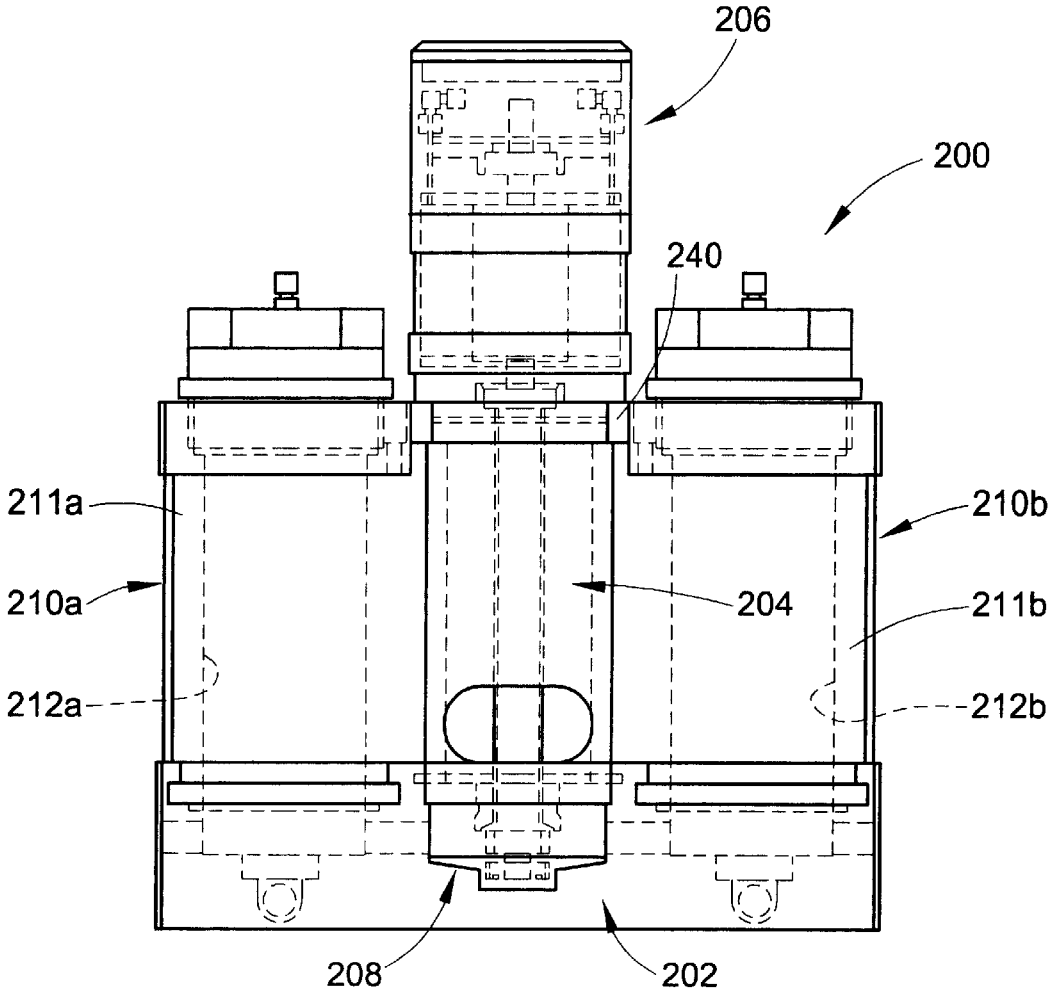
FIG. 4 is a front elevation view of a top-flow centrifugal fluid pump and dual filtration unit according to a second preferred embodiment of the present invention.

Referring now to FIGS. 4 and 5, a top-flow centrifugal fluid pump and dual filtration unit 200 is shown. The fluid pump and filtration unit 200 includes a pump housing or body 202, a pump pedestal 204 mounted to the pump body 202, a drive motor assembly 206 mounted to the pump pedestal 204, an impeller assembly 208 supported within the pump pedestal 204, a first filtration unit 210*a* mounted to the pump body 202, and a second filtration unit 210*b* mounted to the pump body 202. Each of the filtration units 210*a*, 210*b* conventionally includes a housing 211*a*, 211*b* that supports a conventional cartridge-type filter element 212*a*, 212*b*. It should be appreciated that dual filtration paths reduce back pressure on the pumping unit and extend the time between filter changes, relative to the single filtration stage 14 associated with pumping and filtration unit A (FIG. 1).

Figure 7:
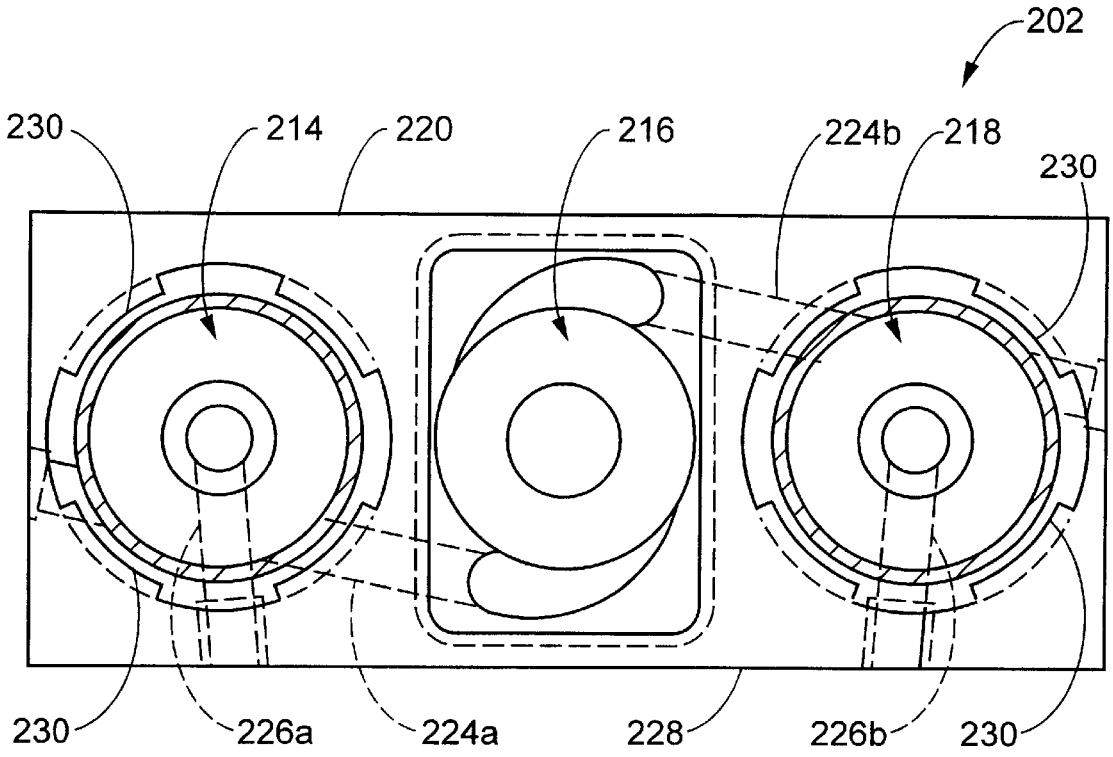
FIG. 7 is a top view of the pump body of FIG. 6.
Figure 6:
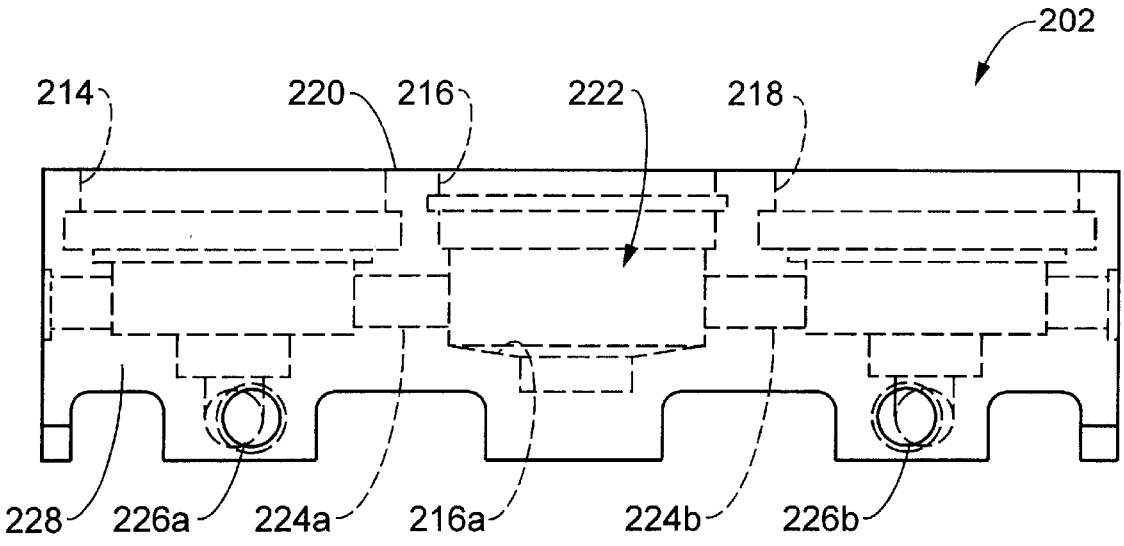
FIG. 6 is a front elevation view of a pump body of the top-flow centrifugal fluid pump and dual filtration unit of FIG. 4.

With reference now to FIGS. 6 and 7, the pump body 202 includes three contoured cavities 214–218 that are recessed from a first or upper surface 220 thereof. The two end cavities 214, 218 define filtration manifolds, while the center cavity 216 defines a pump or impeller chamber 222. Dual pump chamber outlet passageways 224*a*, 224*b* extend between opposing side walls of the pump chamber 216 and the respective filtration manifolds 214, 218. It should be appreciated that the dual opposing outlets 224*a*, 224*b* enhance centering an impeller 244 (described further below) of the impeller assembly 208 within the pump chamber 222 during operation of the unit 200.

The pump chamber passageways 224*a*, 224*b* define inlets to the respective filtration manifolds 214, 218. Filtration unit outlet passageways 226*a*, 226*b* extend between the respective manifolds 214, 218 and a pump body side wall 228. Circumferentially spaced-apart flanges 230 extend partially over the cavities 214, 218 from the pump body upper surface 220. The flanges 230 provide cam surfaces for securing the filter housings 211*a*, 211*b* (FIG. 4) to the pump body 202 in a "twist lock" manner.

Figure 8:
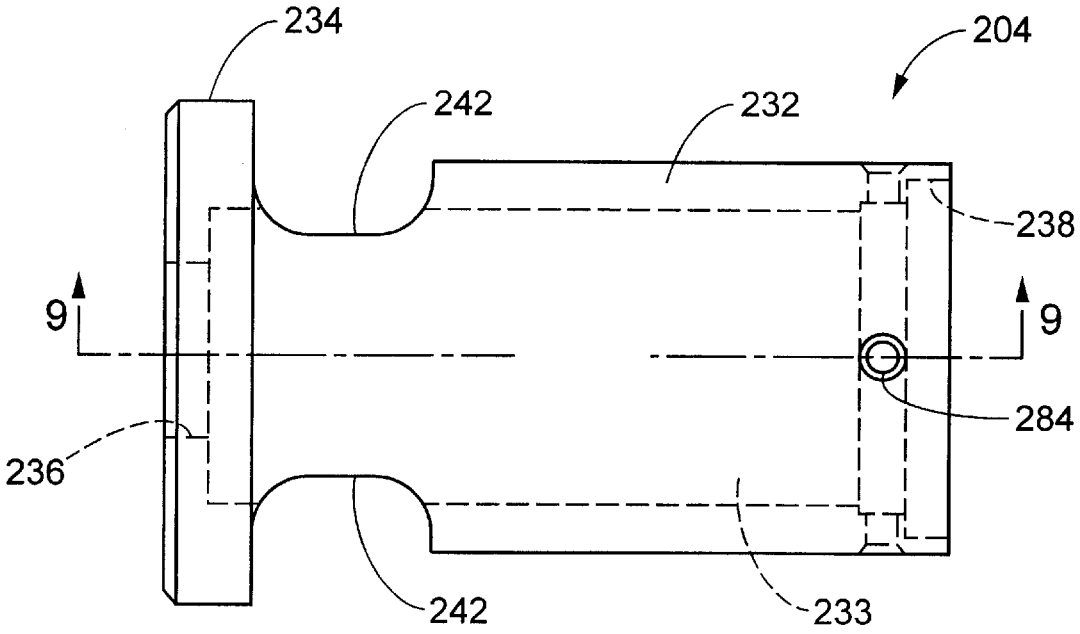
FIG. 8 is a side elevation view of a pump pedestal of the top-flow centrifugal fluid pump and dual filtration unit of FIG. 4.
Figure 9:
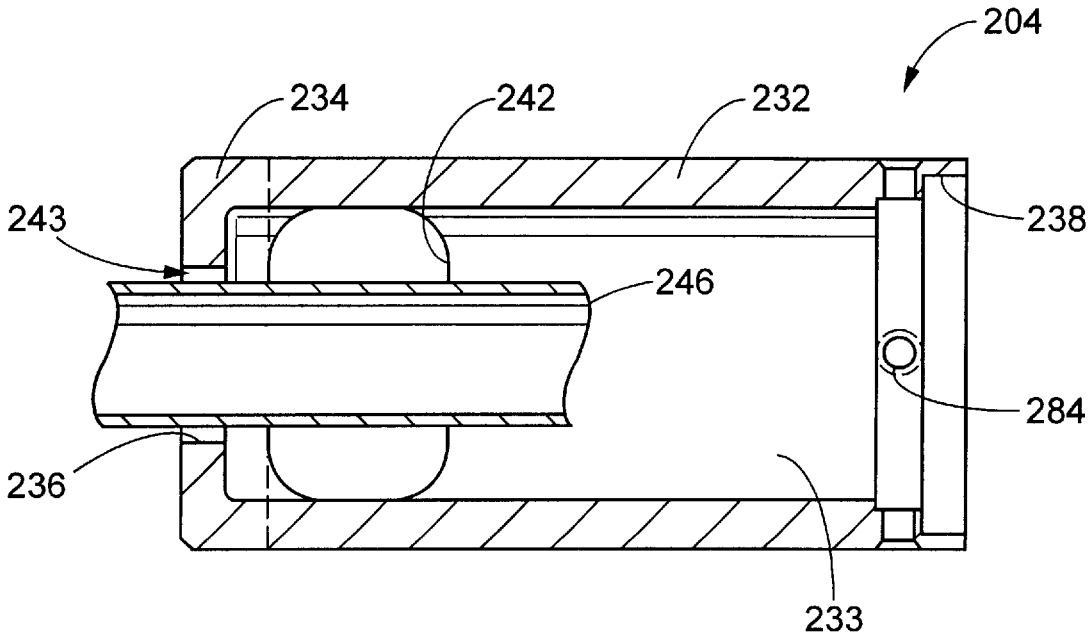
FIG. 9 is a longitudinal cross-sectional view of the pump pedestal taken along the line 9—9 of FIG. 8.

Referring now to FIGS. 8 and 9, the pump pedestal 204 includes a tubular side wall 232. As described in detail below, the tubular side wall 232 concentrically surrounds an impeller shaft sleeve 246 that is rotatably supported within the pump pedestal 204. The pump pedestal 204 and shaft sleeve 246 cooperate to define an annular fluid cavity 233 within the pump pedestal 204. An enlarged end plate 234 is secured to one end of the tubular side wall 232. The end plate 234 includes a central aperture 236. A counter-bored recess 238 is provided at the opposing end of the tubular sidewall. The recess 238 is adapted to receive a mounting or adapter plate 240 (FIG. 4) associated with the drive motor assembly 206. A plurality (e.g. two) of pump inlet apertures or ports 242 extend through the side wall 232 proximate the end plate 234. The size or area of the apertures 242 is maximized or otherwise optimized to reduce the pressure drop on the suction side of the fluid pump.

As best shown in FIG. 9, an annular passageway 243 is defined between an outer surface of the impeller shaft sleeve 246 and the cylindrical side wall defining the end plate central bore 236. The size and shape of the annular passageway 243 can be optimized to control the flow of corrosive fluid from the inlet ports 242 to the pump chamber 222. The pump pedestal end plate 234 mounts over the pump body cavity 216 to define the pump chamber 222. It is contemplated that the pump pedestal 204 can be secured to the pump body 202 with a suitable threaded screw or nut/bolt arrangement. Alternatively, the pump pedestal 204 can be secured to the pump body 202 with camming flanges that cooperate to form a twist lock arrangement in the same manner as the described above with respect to the filtration units 210*a*, 210*b*.

Figure 10:
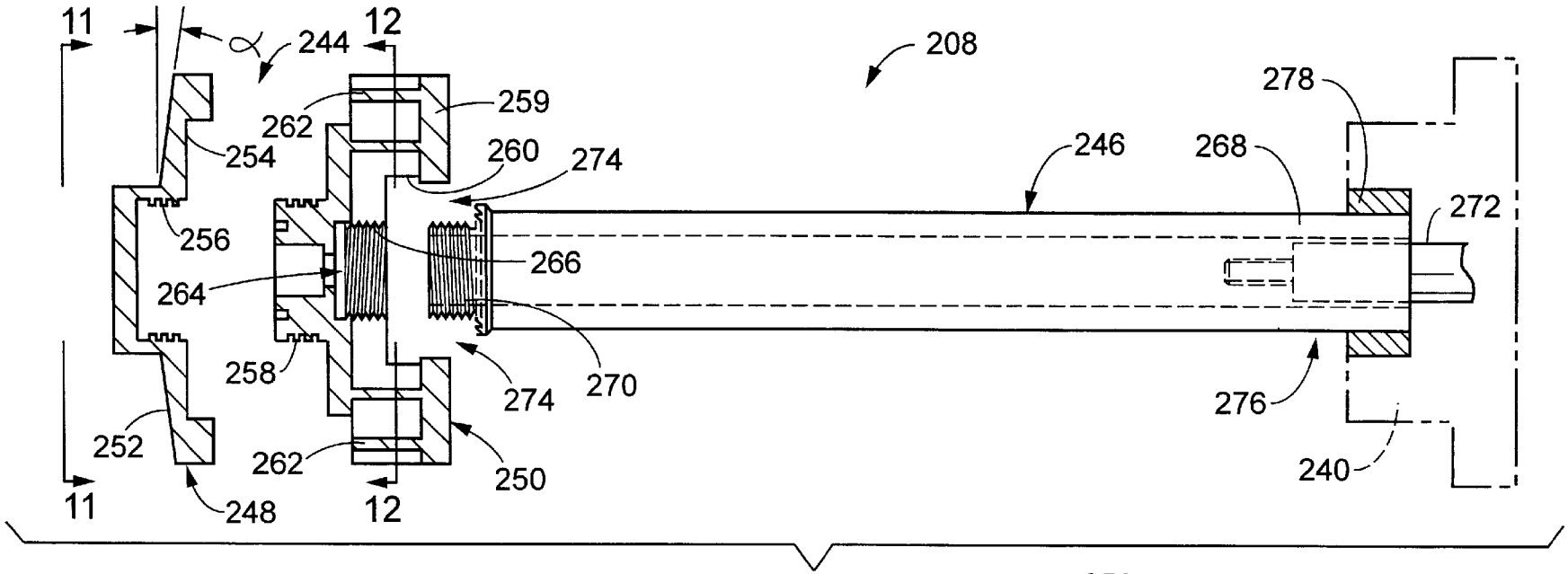
FIG. 10 is an exploded side elevation view, in partial cross section, of an impeller assembly of the top-flow centrifugal fluid pump and dual filtration unit of FIG. 4.
Figure 12:
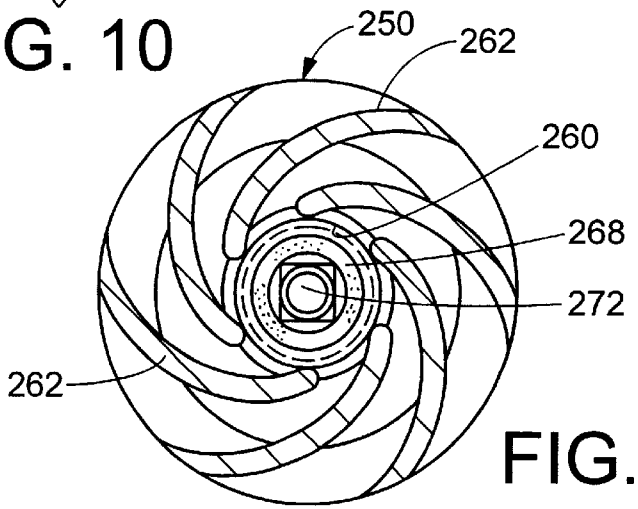
FIG. 12 is a cross section view of the impeller assembly taken along the line 12—12 of FIG. 10.
Figure 11:
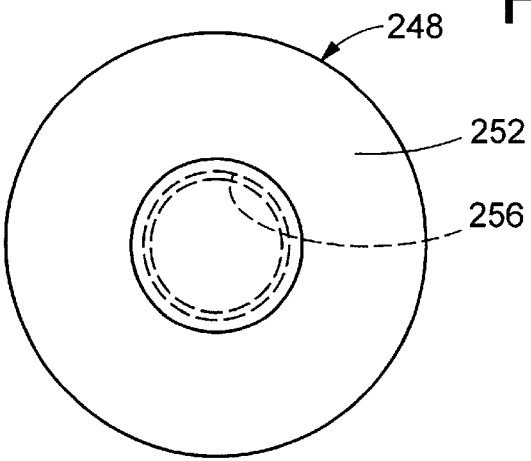
FIG. 11 is an end elevation view of the impeller assembly taken along the line 11—11 of FIG. 10.

With reference to FIGS. 10–12, the impeller assembly 208 comprises an impeller 244 and a shaft sleeve 246. In the embodiment being described, the impeller 244 is formed from a first or cover section 248 and a second or driven section 250. The impeller 244 is formed from two separate sections to facilitate the manufacture thereof. However, it is contemplated that the impeller 244 can be formed as a unitary structure, if desired.

The impeller cover section 244 includes an outer surface 252 that tapers in a radially outward direction at an angle $\alpha$ of about 30°. An inner surface 254 of the cover section 244 includes a plurality of threads 256 adapted to threadably engage mutually corresponding threads 258 associated with the impeller driven section 250. The impeller driven section 250 further includes an annular end wall 259 surrounding an open central cavity 260. A plurality of impeller blades or vanes 262 extend or otherwise spiral radially outward from the cavity 260 to an outer circumference of the impeller. In an assembled state of the impeller 244, the blades or vanes 262 are bounded by the impeller cover 248 and the annular end wall 259. In the embodiment being described, the impeller driven section 250 includes six impeller blades 262. However, any number of impeller blades is contemplated. A central aperture 264 extends through the impeller second section 250 and includes an internally threaded section 266 thereof.

The shaft sleeve 246 is formed from a tubular side wall 268. A threaded end section 270 of the sleeve 246 cooperates with the threaded section 266 of the impeller driven section 250 to rotatably secure the shaft sleeve 246 to the impeller 244. A rotatable output shaft 272 associated with the drive motor assembly 206 extends through the hollow center of the shaft sleeve 246 and is rotatably secured to the impeller driven section 250 by a suitable threaded nut arrangement (not shown). Other attachment arrangements are contemplated. The diameter of the impeller cavity 260 is greater than the diameter of the shaft sleeve 246 so that an annular impeller inlet port 274 is formed when the shaft sleeve 246 is secured to the impeller driven section 250. An upper end 276 of the shaft sleeve 246 passes through the adapter plate 240. A conventional seal assembly 278, such as a labyrinth seal assembly, is interposed between the exterior surface of the shaft sleeve 246 and the adapter plate 240 to prevent corrosive fluid from reaching the drive motor assembly 206.

Thus, in an assembled state of the top-flow centrifugal fluid pump and dual filtration unit 200, as shown in FIG. 4, i) the pump pedestal 204 is secured to the pump body 202, ii) the drive motor assembly 206 is secured to the pump pedestal 204, iii) the impeller assembly 208 extends centrally though the pump pedestal 204, and iv) the drive motor output shaft 272 extends through the shaft sleeve 246 and is secured to the impeller 244 to rotatably suspend the impeller 244 within the pump chamber 222 of the pump body 202. It should be appreciated that the impeller assembly 208 can be removed from the unit 200 by simply removing the pump pedestal 204 from the pump body 202. That is, the pump body 202 and filtration units 210*a,* 210*b* can remain in position within the semiconductor etching system tank or tub 280 (FIGS. 13 and 14) when servicing the impeller assembly 208. In contrast, the impeller 26 (FIG. 1) of the pumping and filtration unit A, must be serviced (i.e. removed) through the inlet 18 thus requiring the housing 10 to be removed from the tub.

With the impeller 244 suspended within the pump chamber 222, the tapered lower surface 252 of the impeller cover section 248 conforms with the tapered lower surface 216*a* (FIG. 6) of the pump block cavity 216. As a result, a fluid bearing is formed between the conforming tapered surfaces 216*a,* 252 to reduce the potential for wear and particle generation during operation of the unit 200.

Figure 14:
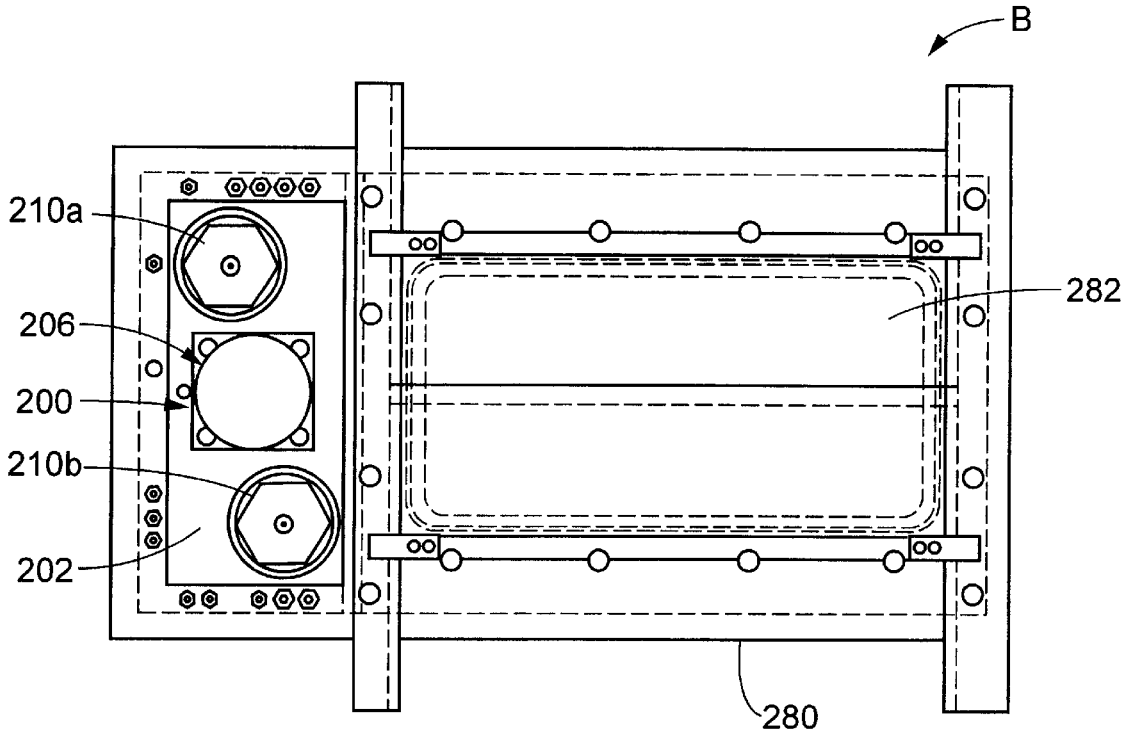
FIG. 14 is a top plan view of the semiconductor etching system of FIG. 13.
Figure 13:
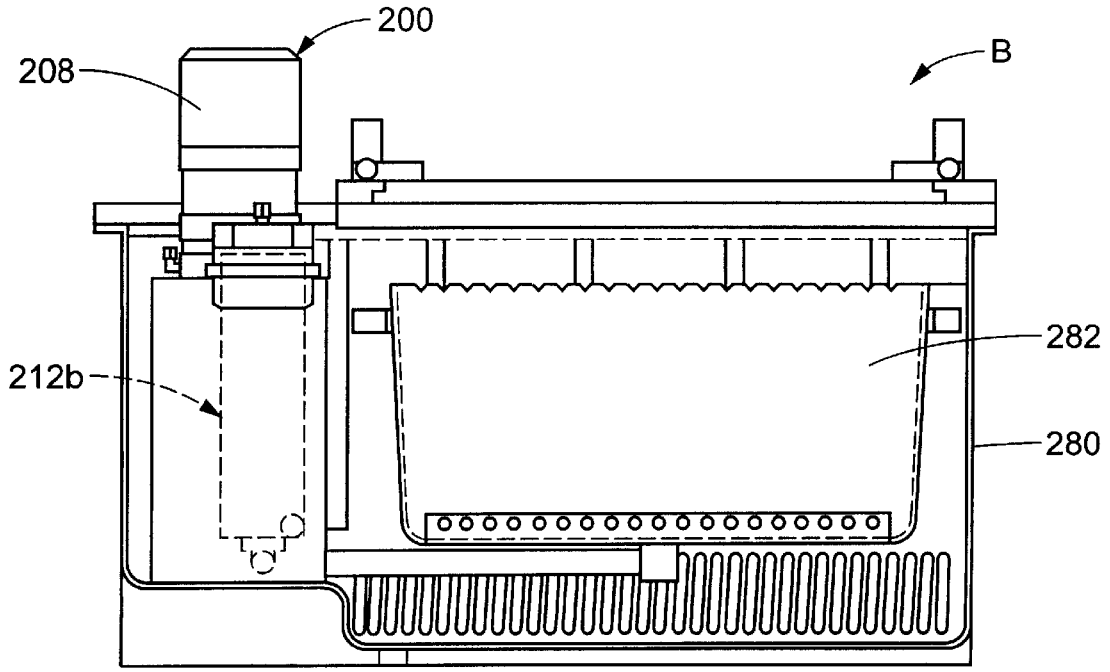
FIG. 13 is a side elevation view of an exemplary semiconductor etching system that incorporates a top-flow centrifugal fluid pump and dual filtration unit of the present invention.

Referring now to FIGS. 13 and 14, an exemplary a semi-conductor etching system B incorporating the top-flow centrifugal fluid pump and dual filtration unit 200 of FIGS. 4–12 is shown. The etching system B can also incorporate the top-flow centrifugal fluid pump 100 of FIGS. 2 and 3. However, the parallel filter arrangement of the top-flow centrifugal fluid pump and dual filtration unit 200 yields a reduced pressure drop at the designed flow rates, creating a more efficient system.

The etching system B includes tank or tub 280 and a weir basket 282 that holds microelectronic circuits or chips. The tub 280 contains a corrosive chemical solution or fluid (e.g. corrosive acid(s) heated to 160–180° C.) which is intended to etch the microelectronic circuits or chips. The pump and filtration unit 200 is positioned within the tub 280 such that the pump inlets 242 and the filtration unit outlets 226*a,* 226*b* are fully submerged below the surface of the corrosive fluid within the tub 280.

As a result, the corrosive fluid will rise to a certain level within the inner annular fluid cavity 233 of the pump pedestal 204. When the drive motor assembly 206 is energized, the motor output shaft 272 and attached impeller 244 and shaft sleeve 246 are caused to rotate together. As a result, a positive suction force is generated by the rotating impeller vanes 262 associated with the second impeller section 250. The suction force draws corrosive fluid from the inlet ports or apertures 242 through the annular passageway 243 and impeller inlet 274, and into the pump chamber 222. The suction force also draws the column of corrosive fluid within the annular fluid cavity 233 away from the seal assembly 278. Thus, corrosive fluid is drawn into the pump chamber 222 in a direction away from the seal assembly 278, then into the spiral passageways 224*a,* 224*b,* and through the filtration units 210*a,* 210*b* to be filtered before being discharged from the outlet ports 226*a,* 226*b.*

In a worst case scenario where both outlet ports 226*a,* 226*b* are blocked (i.e. the pump unit 200 is "dead-headed"), the flow of corrosive fluid completely stops and the fluid within the pump chamber 222 remains in shear. That is, the impeller 244 is unable to draw additional fluid into the pumping chamber 222 through the annular passageway 243 and impeller inlet 274 from the inlet ports 242, and does not drive or otherwise pump or force corrosive fluid back up into the annular fluid cavity 133 toward the seal assembly 278. Even if the corrosive fluid level does reach the seal assembly 278, no forces are generated by the impeller 244 that would cause the seal assembly 278 to fail and thus expose the drive motor unit and/or drive bearings 106 to the corrosive fluid.

Any one or more of the top-flow centrifugal fluid pump and dual filtration unit components including the pump body 202, pump pedestal 204, impeller assembly components including the first and second impeller sections 248, 250 and shaft sleeve 246, and filtration unit housings 211*a,* 211*b* can be made from or coated with suitable corrosion and high-temperature resistant materials such as PTFE (polytetrafluoroethylene), quartz, etc.

The top-flow centrifugal fluid pump 100 and/or the top-flow centrifugal fluid pump and dual filtration unit 200 of the present invention can include a shaft seal purge arrangement that prevents corrosive fumes from the corrosive fluid within the tub 280 (FIGS. 13 and 14) from entering and contaminating the drive motor assembly. More particularly, with reference to FIG. 1, the pump and filtration unit A further includes a gas delivery channel 50 with a threaded outer end 52. The channel 50 extends radially inward from an outer periphery of the adapter plate 34 to the central bore 30. A suitable gas delivery tube 54 can be threadably secured to the channel end 52. The tube 52 delivers a neutral gas, such as nitrogen or carbon dioxide, to the bore 30 and the outer periphery of the shaft sleeve 28. Thus, neutral gas flows upward into the drive motor housing 32 to prevent corrosive fumes from doing the same. The pump pedestal 204 (FIGS. 8 and 9) includes a plurality of apertures 284 that are suitable for delivering a neutral gas to the outer periphery of the shaft sleeve 246. Exhausting the purge gas out of the tank 280 reduces the generation of particles within the corrosive fluid.

The invention has been described with reference to the preferred embodiments. Obviously, modifications and alterations will occur to others upon reading and understanding the preceding description. It is intended that the invention be construed as including all such modifications and alterations.

What is claimed is:

1. A fluid pump comprising:

a housing defining a pump chamber;

a fluid inlet communicating with the pump chamber;

a fluid outlet communicating with the pump chamber;

an impeller positioned within the pump chamber;

a drive shaft extending through the fluid inlet and coupled to the impeller; and, at least one filtration unit coupled to the fluid outlet.

2. The fluid pump of claim 1, further including a plurality of fluid outlets communicating with the pump chamber.

3. The fluid pump of claim 2, further including a plurality of filtration units each communicating with a respective one of the plurality of fluid outlets.

4. The fluid pump of claim 1, wherein the fluid inlet is formed as an annular passage.

5. The fluid pump of claim 1, wherein the drive shaft is coupled to a first side of the impeller, and a plurality of vanes are formed only on the first side of the impeller.

6. The fluid pump of claim 1, further including a shaft sleeve secured to the impeller and surrounding the drive shaft.

7. The fluid pump of claim 6, further including a pump pedestal secured to the housing and surrounding the shaft sleeve, the pump pedestal supporting a drive motor coupled to the drive shaft, and the pump pedestal including at least one fluid inlet port.

8. The fluid pump of claim 7, wherein one or more of the pump chamber, the impeller, the shaft sleeve, and the pump pedestal are formed from or coated with a corrosion and high-temperature resistant material.

9. The fluid pump of claim 8, wherein the corrosion and high-temperature resistant material is from the group consisting of polytetrafluoroethylene and quartz.

10. A corrosive fluid pumping system including a tub adapted to hold a corrosive fluid and a fluid pump, the fluid pump comprising:

a housing defining a pump chamber;

a fluid inlet communicating with the pump chamber;

an impeller positioned within the pump chamber;

a drive shaft extending through the fluid inlet and coupled to the impeller;

a shaft sleeve secured to the impeller and surrounding the drive shaft;

a pump pedestal secured to the housing and surrounding the shaft sleeve, the pump pedestal supporting a drive motor coupled to the drive shaft, and the pump pedestal including at least one fluid inlet port;

wherein one or more of the pump chamber, the impeller, the shaft sleeve, and the pump pedestal are formed from or coated with a corrosion and high-temperature resistant material; and, wherein the corrosion and high-temperature resistant material is from the group consisting of polytetrafluoroethylene and quartz.

11. The fluid pump of claim 10, further including at least one fluid outlet communicating with the pump chamber.

12. The fluid pump of claim 10, further including a plurality of fluid outlets communicating with the pump chamber.

13. The fluid pump of claim 12, further including a plurality of filtration units each communicating with a respective one of the plurality of fluid outlets.

14. The fluid pump of claim 10, further including at least one filtration unit coupled to the fluid outlet.

15. The fluid pump of claim 10, wherein the fluid inlet is formed as an annular passage.

16. The fluid pump of claim 10, wherein the drive shaft is coupled to a first side of the impeller, and a plurality of vanes are formed only on the first side of the impeller.

17. A fluid pump for a corrosive fluid comprising:

a housing defining a pump chamber;

a corrosion resistant impeller positioned within said pump chamber;

a drive shaft construction for rotating the impeller wherein said drive shaft construction comprises:

a drive shaft, and a corrosion resistant shaft sleeve surrounding said drive shaft;

an opening in a wall of said pump chamber through which said drive shaft construction extends into said pump chamber;

a toroidal fluid inlet defined between said drive shaft construction and a wall of said housing through which fluid flows into said pump chamber;

a fluid outlet communicating with said pump chamber; and, a filtration unit coupled to the fluid outlet.

18. The fluid pump of claim 17 wherein said filtration unit is mounted in said housing.

19. The fluid pump of claim 18 further comprising a pump pedestal secured to the housing and surrounding the shaft sleeve, the pump pedestal supporting a drive motor coupled to the drive shaft.

20. A fluid pump for a corrosive fluid comprising:

a housing defining a pump chamber;

a corrosion resistant impeller positioned within said pump chamber;

a drive shaft construction for rotating the impeller wherein said drive shaft construction comprises:

a drive shaft, and a corrosion resistant shaft sleeve surrounding said drive shaft;

an opening in a wall of said pump chamber through which said drive shaft construction extends into said pump chamber;

a toroidal fluid inlet defined between said drive shaft construction and a wall of said housing through which fluid flows into said pump chamber;

a fluid outlet communicating with said pump chamber; and, two opposed fluid outlets which communicate with the pump chamber.

21. The fluid pump of claim 20 further comprising at least one filteration unit coupled to each of the two opposed fluid outlets of the pump chamber.

* * * * *